US007517181B2

(12) United States Patent
Dunaway et al.

(10) Patent No.: US 7,517,181 B2
(45) Date of Patent: Apr. 14, 2009

(54) TRACK FITTING FOR A CARGO SECURITY SYSTEM

(75) Inventors: Jeffrey Dunaway, Louisville, KY (US); Jeffrey LaMaster, Louisville, KY (US); Jennifer Robbins, Vine Grove, KY (US)

(73) Assignee: J3, LLC, Vinegrove, KY (US)

( * ) Notice: Subject to any disclaimer, the term of this patent is extended or adjusted under 35 U.S.C. 154(b) by 0 days.

(21) Appl. No.: 11/856,952

(22) Filed: Sep. 18, 2007

(65) Prior Publication Data

US 2008/0019789 A1 Jan. 24, 2008

Related U.S. Application Data

(63) Continuation of application No. 10/797,501, filed on Mar. 10, 2004, now abandoned.

(60) Provisional application No. 60/454,228, filed on Mar. 13, 2003.

(51) Int. Cl.
*B61D 45/00* (2006.01)
*B65D 63/00* (2006.01)
*G05G 5/06* (2006.01)

(52) U.S. Cl. ..... 410/105; 410/104; 74/527

(58) Field of Classification Search ..... 74/527, 74/531; 244/118.6; 411/553; 410/102, 104, 410/105, 97; 296/136.1; 24/265 CD, 115 K; *F16P 7/10; F16G 11/10*

See application file for complete search history.

(56) References Cited

U.S. PATENT DOCUMENTS

| | | | | |
|---|---|---|---|---|
| 5,765,978 | A * | 6/1998 | Looker et al. | 410/105 |
| 5,823,724 | A * | 10/1998 | Lee | 410/104 |
| 6,644,901 | B2 * | 11/2003 | Breckel | 410/104 |
| 6,715,820 | B1 * | 4/2004 | Haas | 296/136.1 |
| 7,156,593 | B1 * | 1/2007 | Saward et al. | 410/104 |
| 7,390,154 | B2 * | 6/2008 | Womack et al. | 410/105 |

FOREIGN PATENT DOCUMENTS

| | | | |
|---|---|---|---|
| GB | 2417 520 A | * | 3/2006 |
| JP | 4-189637 | * | 7/1992 |

* cited by examiner

*Primary Examiner*—Vinh T. Luong
(74) *Attorney, Agent, or Firm*—Stites & Harbison, PLLC; Jeffrey A. Haeberlin

(57) ABSTRACT

A track fitting used to secure a covering to a track extending along an item includes a body and a plunger. The body of the track fitting has at least one foot, adapted to be received in one of a series of openings defined by the track, and the body is also adapted to receive and secure a portion of the covering. The plunger of the track fitting is placed adjacent to and is vertically moveable with respect to the body. The plunger generally moves between a first position that allows movement of the track fitting along the track and a second position in which the plunger engages one of the openings defined by the track, preventing further movement of the track fitting along the track.

7 Claims, 7 Drawing Sheets

TRACK FITTING FOR A CARGO SECURITY SYSTEM

CROSS REFERENCES TO RELATED APPLICATIONS

This application is a continuation-in-part of U.S. patent application Ser. No. 10/797,501, filed Mar. 10, 2004, which application claims priority to U.S. Provisional Application Ser. No. 60/454,228, filed Mar. 13, 2003. The entire disclosures of U.S. patent application Ser. No. 10/797,501 and U.S. Provisional Application Ser. No. 60/454,228 are incorporated herein by this reference.

FIELD OF THE INVENTION

The present invention relates to the field of cargo restraint apparatus for airplanes and other vehicles, and, more particularly, to a track fitting for a cargo security system, which is designed to prevent, detect, and deter the theft and the unauthorized introduction of foreign materials into a cargo load.

BACKGROUND OF THE INVENTION

When cargo is being transported, for example, by commercial aircraft, it must be arranged on a pallet, such as a Unit Load Device (ULD), before being loaded into the cargo section of the aircraft. If desired, the cargo may be covered with weatherproof material, such as a layer of plastic, to provide protection from external elements. Thereafter, a net is placed over the cargo and secured to the pallet with anchoring devices, thereby securing the cargo to the pallet. Typically, the cargo net is secured to the pallet in the following manner. The pallet is provided with a track running along its perimeter, a so-called "pallet-track." The cargo net is equipped with permanently attached anchoring devices, known as cargo track fittings, spaced at predetermined intervals about the perimeter of the net. Each track fitting has a base designed to mate with openings formed in the pallet-track allowing it to be secured to the track.

The net primarily serves to protect the interior of the aircraft from damage caused by the shifting of the cargo during transport. In this regard, the net is capable of securing the cargo such that it does not fall from the pallet or become lost during shipment; however, the net does little to protect against the introduction of foreign material, such as explosives or contraband, into the cargo or the removal and theft of items from the cargo. Indeed, by design, the net has a plurality of holes through which material may be introduced or removed. Additionally, gaps remain between the top of the pallet and the base of the net between points where the track fittings secure the net to the pallet. Furthermore, the track fittings are easily disengaged from the pallet-track, allowing introduction of foreign material or removal of larger items. In this manner, potentially dangerous foreign materials and other contraband can be introduced into and/or valuable cargo may be removed without detection.

Accordingly, there is a need in the art for a method and device that satisfactorily addresses the problems associated with known cargo restraint systems as set forth above.

SUMMARY OF THE INVENTION

The present invention addresses the above identified problems, and others, by providing a system for securing cargo during transport that prevents, detects and deters both the theft of cargo and the unauthorized introduction of foreign materials into the cargo load.

The present invention is a track fitting for a cargo security system. The track fitting may be used to anchor a variety of items to a track; for example, the track fitting may be used as part of a complete cargo security system, which includes a cargo covering. An exemplary embodiment of the track fitting includes a body and a plunger that is placed over a front portion of the body. The body also includes a substantially C-shaped rear portion, which is supported by two integral feet and defines an opening between the feet, the importance of which will be discussed below.

The exemplary track fitting is designed to be anchored to a track, for example, a track extending around the perimeter of a traditional pallet used in the cargo handling industry. The track defines a channel with a series of enlarged openings spaced at predetermined intervals along its length. Each foot of the rear portion of the body of the fitting fits into each of the enlarged openings defined by the track. Additionally, a lower end of the plunger fits into each of the enlarged openings defined by the track. To secure the exemplary track fitting to the track, the plunger is pulled upward, into a first position, and the track fitting is placed on the track by lowering the feet into adjacent enlarged openings. The track fitting is then slid within the channel defined by the track until the lower end of the plunger is aligned with a desired enlarged opening. The plunger is then released into a second position, allowing the lower end of the plunger to drop into the desired enlarged opening, thereby securing the track fitting to the track.

A plurality of exemplary track fittings may used as part of a complete cargo security system, which includes a cargo covering and the plurality of track fittings for securing the covering to a track. In the exemplary embodiment, the substantially C-shaped rear portion of each track fitting is hooked to a catch on the covering and the track fitting is brought down and secured to the track. A sufficient number of fittings are used to secure the covering to the track such that no gap exists between the covering and the upper surface of the track. Each secured track fitting may be locked to the track by temporarily disabling the movement of the plunger. For example, each exemplary track fitting may include an upwardly extending projection, which extends through the top of the plunger and defines an aperture. A locking cable may be fed through the apertures in the projections of each track fitting secured to the track, blocking the upward sliding movement of each plunger. The ends of the cable may then be locked to one another, thereby locking the covering to the track such that foreign material cannot be introduced, nor can cargo be removed without tampering with the system. The ends of the locking cable may be secured with a fastening apparatus, such as a cable tie, which may thereafter be covered with a tag or label carrying a tracking code. In this regard, the locking cable cannot be removed without cutting the fastening apparatus and destroying the tracking label, thereby signaling that the cargo has been tampered with.

Additionally, the exemplary covering may have an inside surface and an outside surface, wherein the two surfaces are contrasting colors. If the covering was cut, for example, to effect introduction of material into or removal of material from the cargo, the contrasting color on the inside surface of the covering would become clearly visible, thereby signaling that the cargo had been tampered with. Alternatively, a thread-like material, that frays when cut, could be woven into the surface of the covering. If the covering was cut, the frayed material would provides a signal that the cargo had been tampered with.

The system and track fitting may also be used concurrently with a tradition cargo net. For example, the cargo net could be placed over the covering and the track fitting could be used to secure both the covering and the cargo net to a track. The exemplary track fitting could also be used to secure a traditional cargo net to a track, for example, it could be used in place of a traditional cargo-net-repair kit.

DETAILED DESCRIPTION OF THE INVENTION

Figure 1:
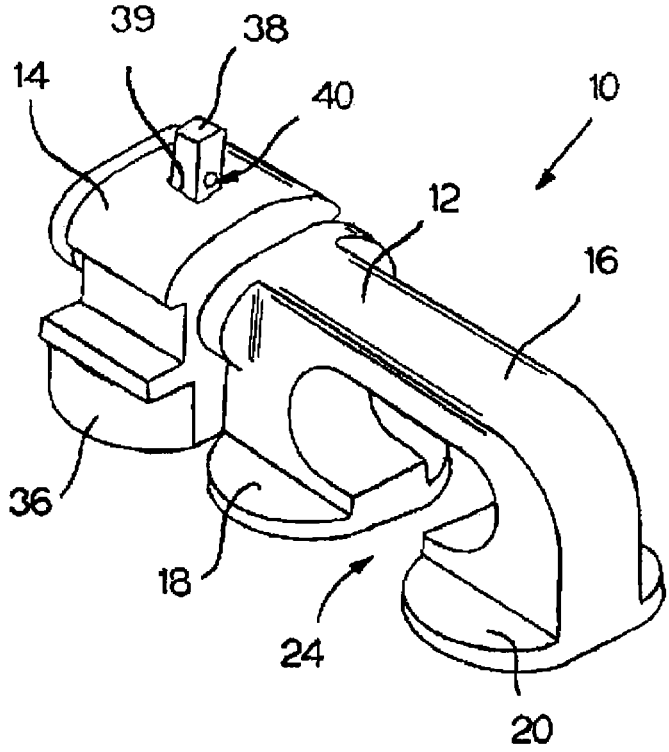
FIG. 1 is a perspective view of an exemplary embodiment of a track fitting of the present invention, illustrating the plunger in the second position.
Figure 1A:
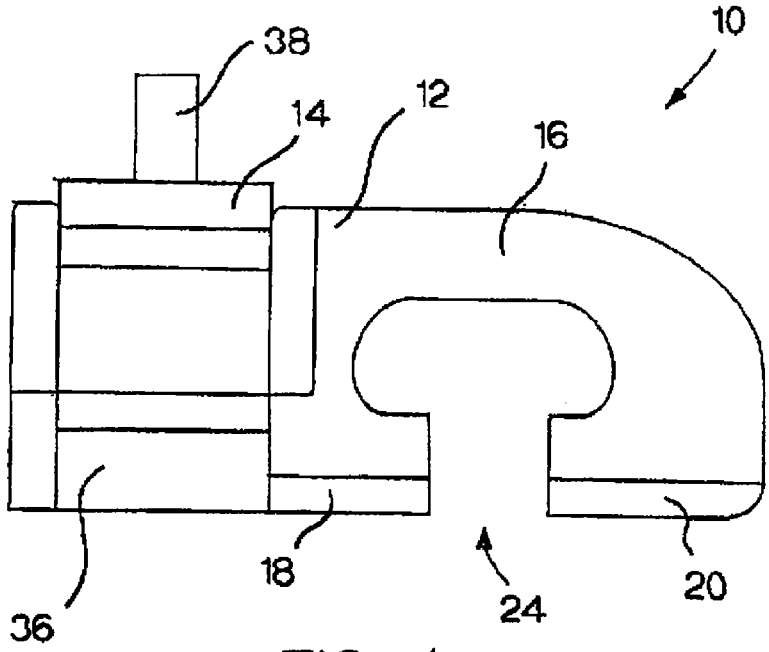
FIG. 1A is a side view of the track fitting of FIG. 1, again illustrating the plunger in the second position.

The present invention is a track fitting for a cargo security system for securing cargo during transport, the system being designed to prevent, detect and deter both the theft of cargo and the unauthorized introduction of foreign materials into the cargo load.

An exemplary embodiment of the track fitting 10 of the present invention will first be discussed with reference to FIGS. 1, 1A, 2, 2A, and 7. The track fitting 10 includes a body 12 and a plunger 14. The plunger 14 defines a front portion receiving aperture 15. The body 12 has a substantially C-shaped rear portion 16, supported by an integral first foot 18 and an integral second foot 20, and a front portion 22 which is received in the front portion receiving aperture 15 of the plunger 14. The C-shaped rear portion 16 of the body 12 defines an opening 24 between the feet 18, 20, the importance of which will be discussed further below.

Figure 3:
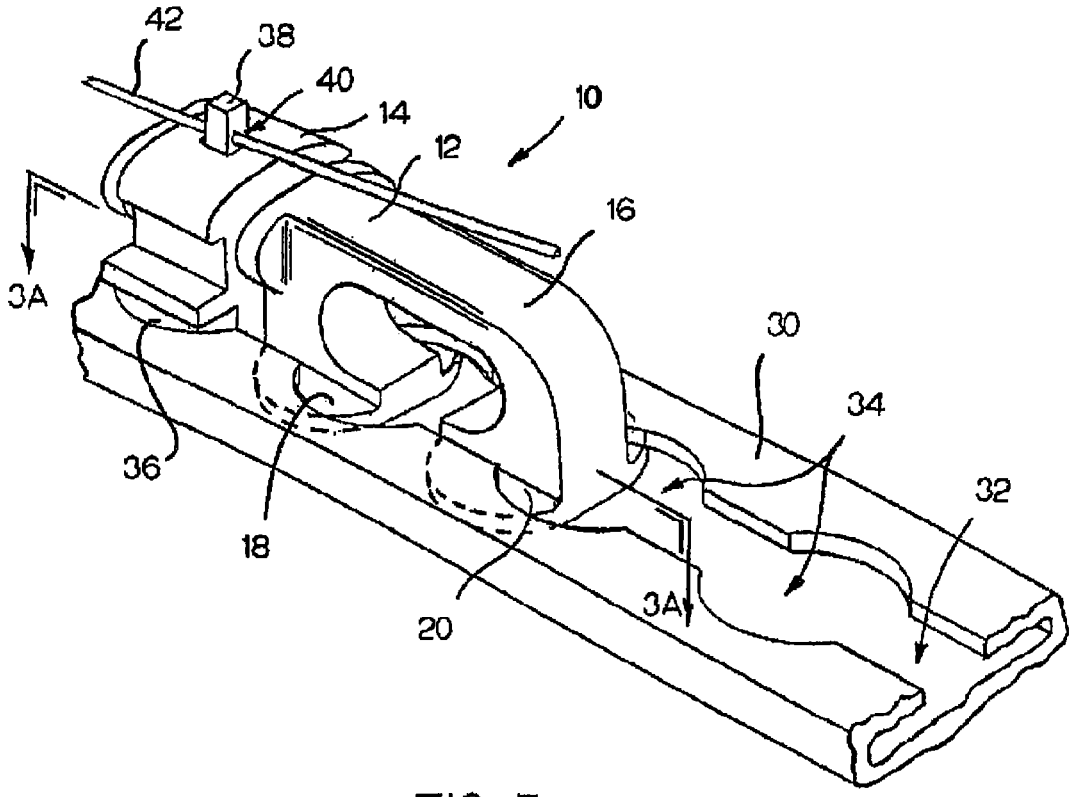
FIG. 3 is a perspective view of the track fitting of FIG. 1, positioned on a track.
Figure 3A:
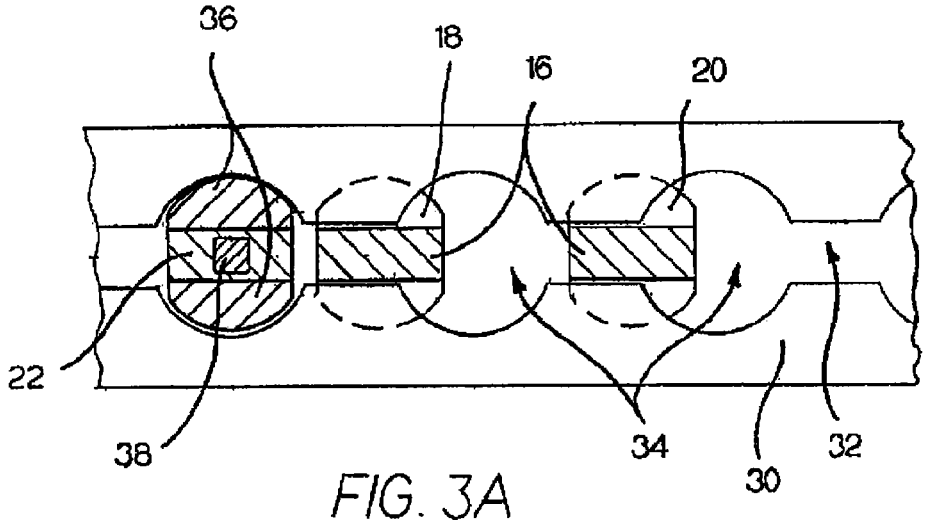
FIG. 3A is a cross sectional view of the track fitting taken along line 3A-3A of FIG. 3.

Referring now to FIGS. 3 and 3A, the exemplary track fitting 10 is designed to be anchored to a track 30, for example, a track extending around the perimeter of a traditional pallet used in the cargo handling industry. However, it is contemplated that the track could be a track secured to the bed of a pick-up truck, or a track mounted to any other desired object, without departing from the spirit and scope of the present invention. The track 30 defines a channel 32 with a series of enlarged openings 34 spaced at predetermined intervals along its length. The feet 18, 20 of the C-shaped rear portion 16 of the body 12 of the track fitting 10 are each adapted to be received by each of these enlarged openings 34. Additionally, a lower end 36 of the plunger 14 is adapted to be received by each of these enlarged openings 34.

Figure 2:
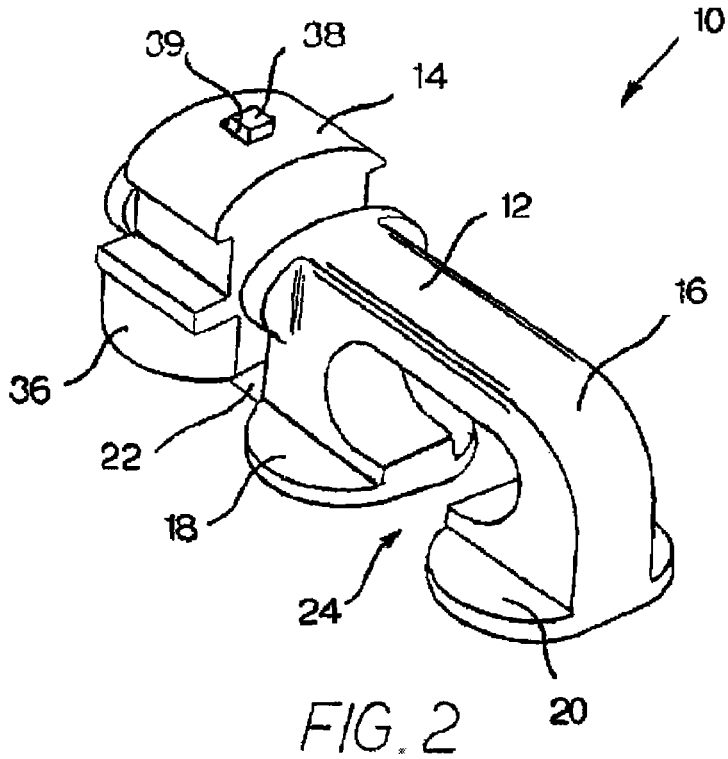
FIG. 2 is an alternate perspective view of the track fitting of FIG. 1, illustrating the plunger in the first position.
Figure 2A:
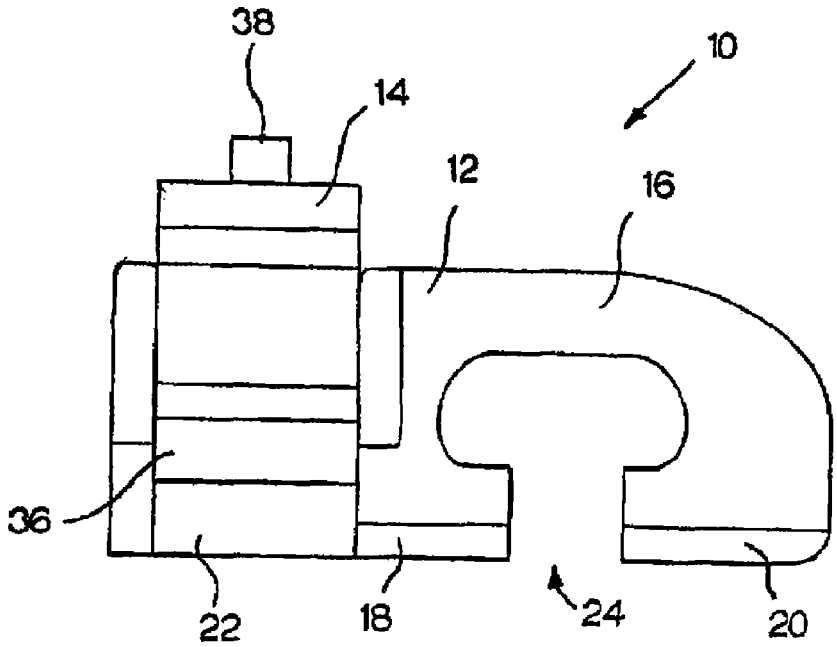
FIG. 2A is a side view of the track fitting of FIG. 1, again illustrating the plunger in the first position.
Figure 8:
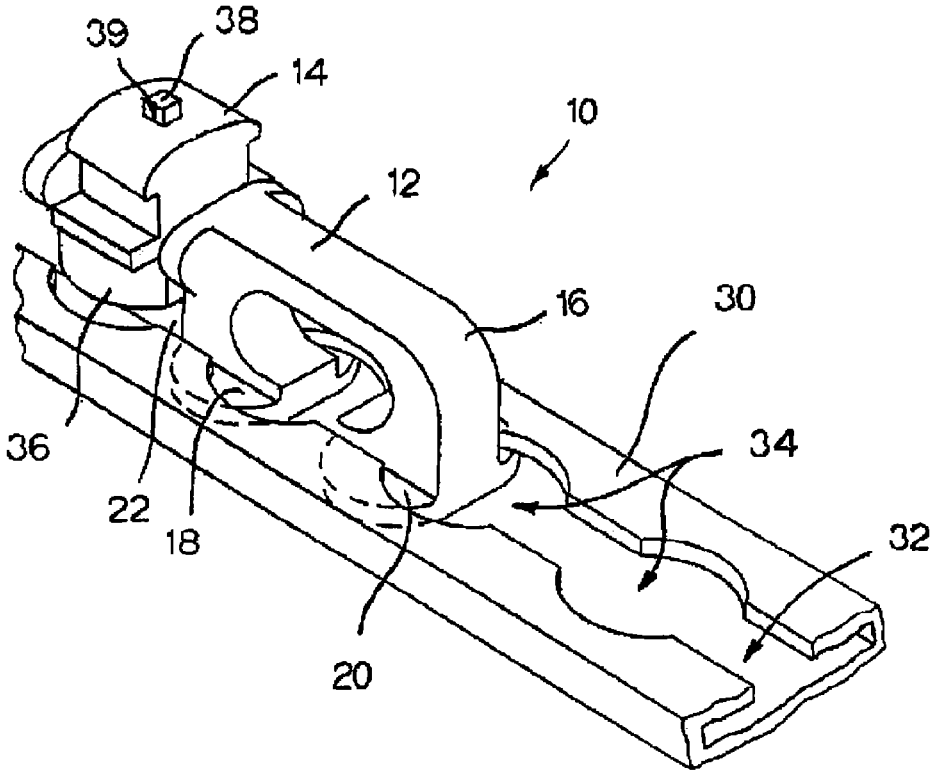
FIG. 8 is a perspective view of the track fitting of FIG. 1, positioned on a track with the plunger in a first disengaged position.

To secure the exemplary track fitting 10 to the track 30, the plunger 14 is pulled into a first disengaged position, shown in FIGS. 2, 2A, and 8. In this position, the plunger lower end 36 is disengaged from the track 30. Although it is not necessary, in certain embodiments, the plunger 14 is slidably secured to the front portion 22 of the body 12 and biased toward a second position, shown in FIGS. 1 and 1A, using, for example, a spring. With reference again to FIGS. 3 and 3A, the track fitting 10, with the plunger 14 in the first position, is placed on the track 30 by lowering the feet 18, 20 into adjacent enlarged openings 34. The track fitting 10 is then slid within the channel 32 defined by the track 30 until the lower end 36 of the plunger 14 is aligned with a desired enlarged opening 34. The plunger 14 is then released into the second position, allowing the lower end 36 of the plunger 14 to drop into the desired enlarged opening 34, thereby preventing the horizontal sliding of the fitting 10 within the track 30. When the lower end 36 of the plunger 14 is aligned with the desired enlarged opening 34, the feet 18, 20 are not aligned with any enlarged opening 34, thus, the feet 18, 20 prevent the vertical movement of the fitting 10 from the track 30. In this manner, the track fitting 10 is secured to the track 30.

Figure 4:
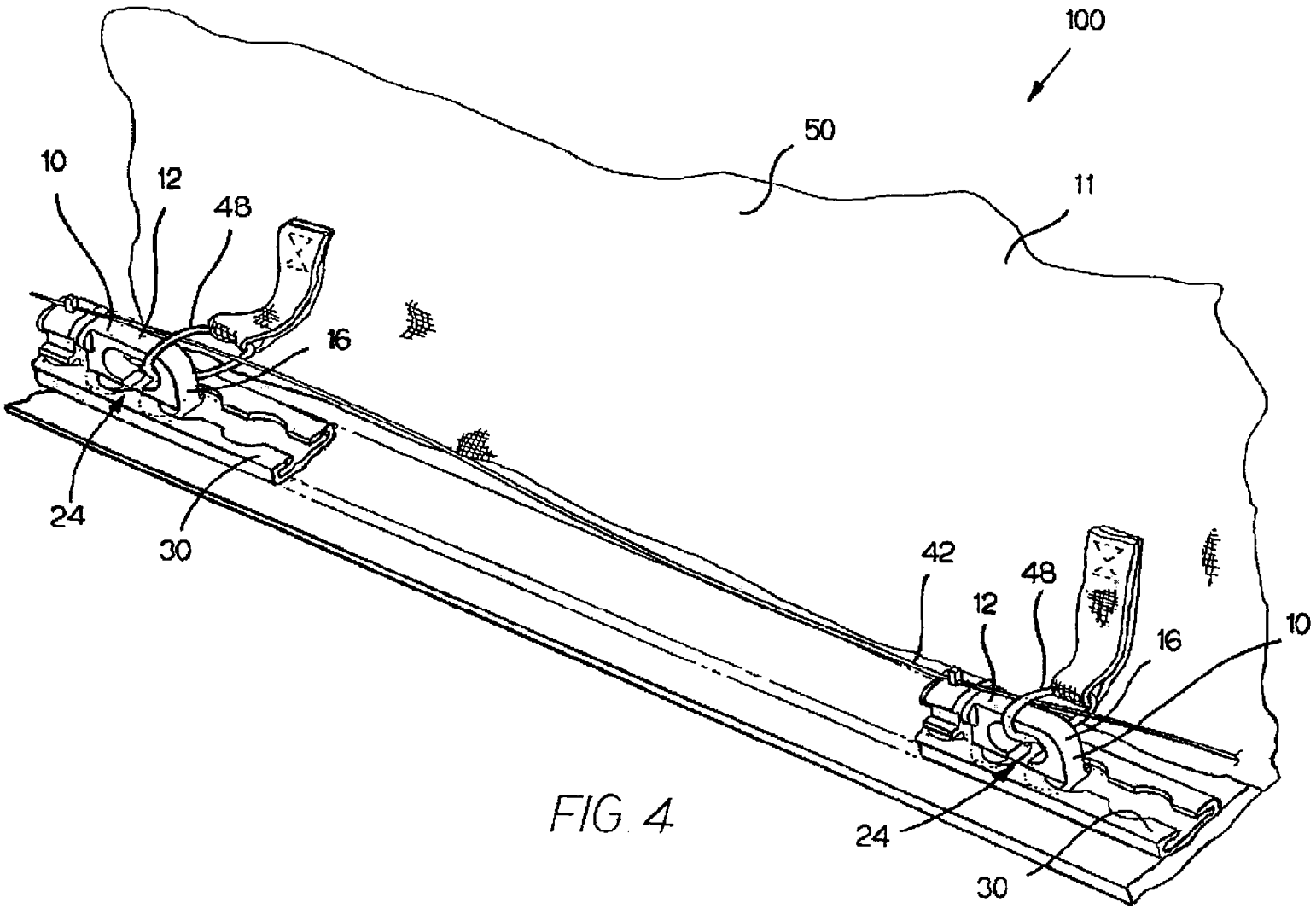
FIG. 4 is a perspective view of two exemplary track fittings of the present invention, positioned on a track and securing a covering.

Turning now to FIG. 4, a plurality of exemplary track fittings 10 may be used as part of a complete cargo security system 100, which additionally includes a cargo covering 11, the track fittings 10 being used to secure the covering 11 to a discrete section of track 30 positioned along the periphery of a pallet or similar support. In the exemplary embodiment, the substantially C-shaped rear portion 16 of the body 12 of each track fitting 10 is hooked to a catch or eye 48 on the covering 11. For example, the covering 11 may include a plurality of permanently attached O-shaped rings, each of which act as the catch 48. The rear portion 16 of the base 12 of each track fitting 10 may receive one of these catches 48 before the fitting 10 is brought down and secured to the track 30. While the fitting 10 is secured to the track 30, the opening 24 defined by the rear portion 16 of the body 12 is blocked by the track 30 such that the catch 48 cannot be unhooked from the fitting 10. Additionally, it is contemplated that the covering 11 include several rows of catches 48 (e.g., attached rings) allowing the covering 11 to be adjusted to fit tightly over cargo loads of various sizes. It should be noted that the catches 48 of the depicted covering 11 are but one example of a contemplated catch capable of being accepted by and hooked to an exemplary fitting, and other catches of various shapes and sizes could certainly be employed without departing from the spirit and scope of the present invention.

Referring still to FIG. 4, a sufficient number of fittings 10 are used to secure the covering 11 to the track 30 such that no significant gap exists between the covering 11 and the upper surface of the track 30. After the track fittings 10 have been secured to the track 30, each can be locked thereto by temporarily disabling the movement of the plunger 14. As best shown in FIGS. 1, 1A, 2 and 2A, the body 12 of the exemplary track fitting 10 further includes an upwardly extending projection 38, which extends through a projection receiving aperture 39 through the top of the plunger 14 and has an aperture 40 defined therethrough. As shown in FIG. 3, the aperture 40 is adapted for receiving a locking cable 42, and, as shown in FIG. 4, the locking cable 42 can be fed through the apertures 40 in the projections 38 of each of a plurality of track fittings 10 secured to the track 30, blocking the upward sliding movement of each plunger 14. The ends of the cable 42 may then be locked to one another, thereby locking the covering 11 to the track 30 such that foreign material cannot be introduced into the cargo, nor can cargo be removed, without tampering with the system 100.

Figure 6:
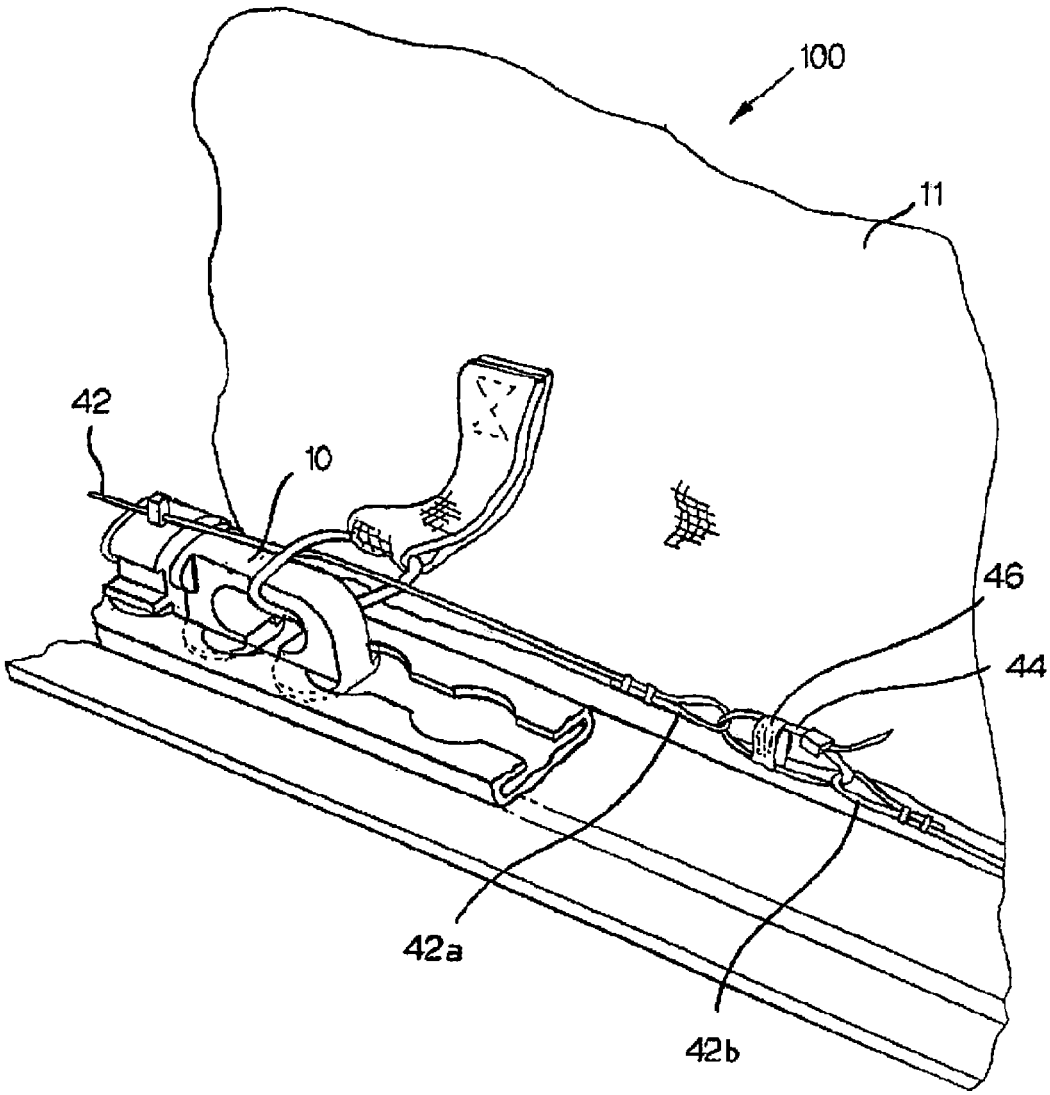
FIG. 6 is another enlarged perspective view of one of the exemplary track fittings of FIG. 4.
Figure 7:
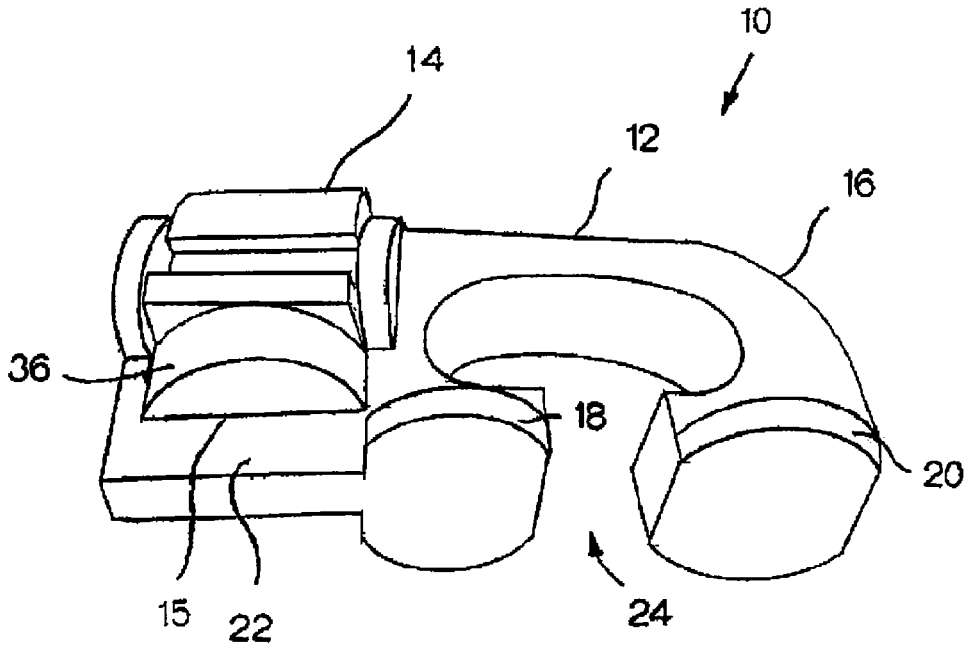
FIG. 7 is another alternate perspective view of the track fitting of FIG. 1.

For example, as shown in FIG. 6, the ends 42*a*, 42*b* of the locking cable 42 could be secured with a fastening apparatus 44, such as a cable tie, which may thereafter be covered with a tag or label 46 carrying a tracking code such that the locking cable 42 cannot be removed without cutting the fastening apparatus 44 and destroying the tracking label 46. Thus, if the fastening apparatus 44 has been tampered with, such tampering can be easily detected because, even if the same or similar fastening apparatus is used to reattach the ends 42*a*, 42*b* of the locking cable 42, the tracking label cannot be reproduced. Of course, this is but one example of a manner in which a plurality of track fittings 10 may be locked to the track 30, and other methods could be used without departing from the spirit and scope of the present invention. For example, each track fitting could be provided with an individual fastening apparatus allowing each track fitting to be locked to the track individually.

Referring back to FIG. 4, it is contemplated that an exemplary covering 11 may have an inside surface (not shown) and an outside surface 50, wherein the two surfaces are contrasting colors. For example, the inside surface (not shown) could be red, and the outside surface 50 could be white. If the covering 11 was cut, for example, to effect introduction of material into or removal of material from the cargo, the contrasting color on the inside surface (not shown) of the covering 11 would become clearly visible, thereby signaling that the cargo had been tampered with. Alternatively, a thread-like material, that frays when cut, could be woven into the surface of the covering 11. If the covering 11 was cut, for example, to effect introduction of material into or removal of material from the cargo, the frayed material would provides a signal that the cargo had been tampered with.

In any event, the covering 11 in this example is made of water-resistant, durable, lightweight, fiberglass-woven material to provide durability and protection from damage to the cargo and to eliminate the need to pre-wrap the cargo with weather-proof material. However, the covering 11 may be made from a variety of durable and substantially flexible materials, for example, nylon, PP webbing, natural or synthetic cloth, or leather, without departing from the spirit and scope of the present invention.

Figure 5:
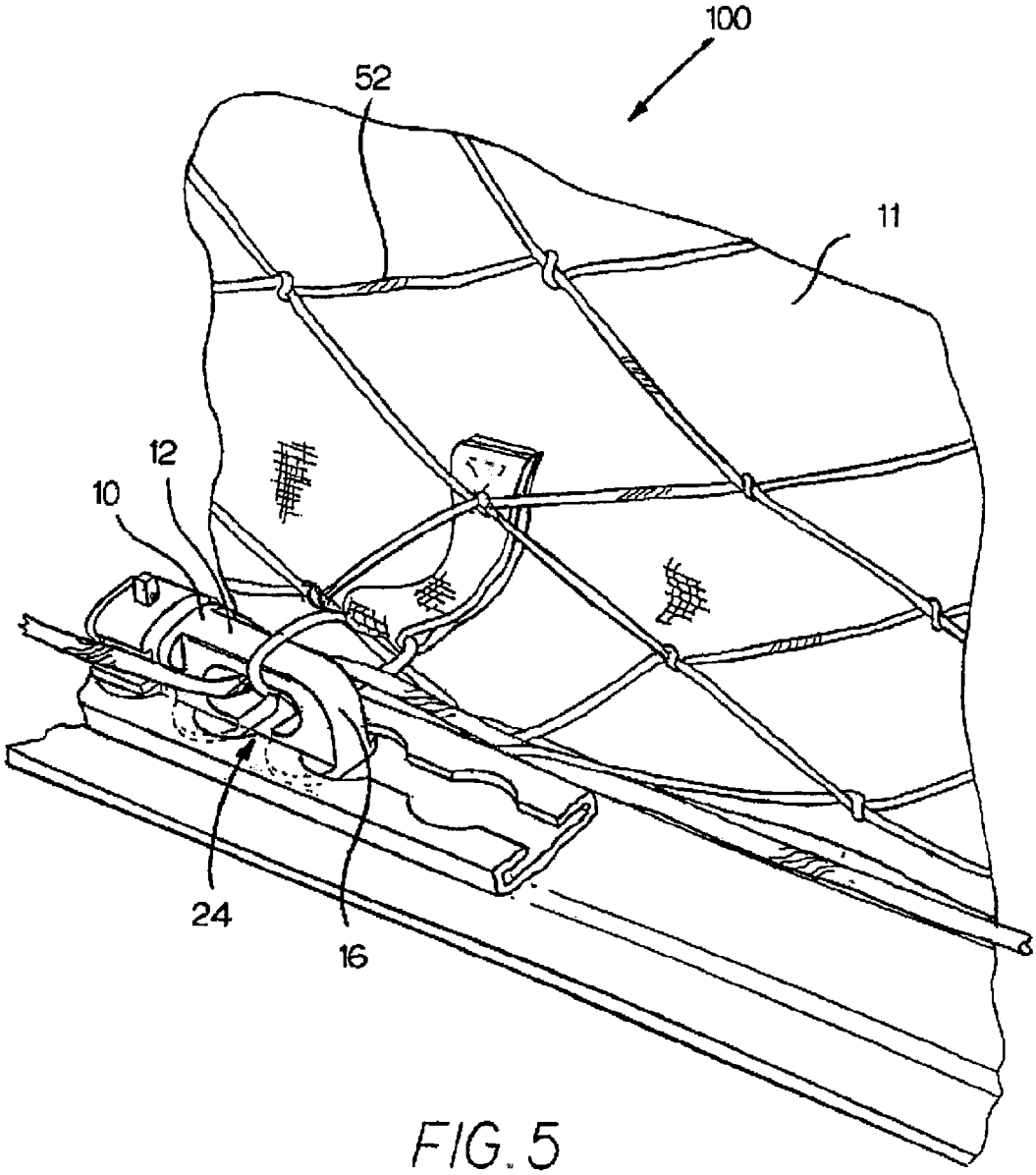
FIG. 5 is an enlarged perspective view of one of the exemplary track fittings of FIG. 4.

Additionally, with reference to FIG. 5, the system 100 and track fitting 10 of the present invention may be used concurrently with a traditional cargo net 52. In this regard, it is contemplated that the track fitting 10 of the present invention could be used as an alternative to a traditional cargo-net-repair kit. As mentioned above, a cargo net is typically equipped with permanently attached track fittings spaced at predetermined intervals about the perimeter of the net. If the net is damaged, allowing one or more of these attached track fittings to become detached, a traditional cargo-net-repair kit is used in place of each detached fitting to secure the damaged net to the track of a pallet. A traditional cargo-net-repair kit comprises a traditional track fitting having a body defining an aperture through which an adjustable strap is threaded. The strap includes hooks allowing it to be attached to two parts of the damaged net, thereby securing the net to the traditional track fitting and allowing it to be secured to the track of the pallet. Because the rear portion 16 of the body 12 of the track fitting 10 of the present invention defines an opening 24, forming a hook, the track fitting 10 of the present invention can hooked to a damaged net and secured to the pallet making it an ideal alternative to a traditional cargo-net-repair kit.

Finally, it is contemplated that the track fitting 10 of the present invention be compatible not only with the tracks 30 of pallets currently being used in the cargo handling industry, but also with tracks having alternative designs. For example, tracks could be mounted to the bed of a truck, and the fitting of the present invention could be used to secure a covering to the track, thereby securing and protecting cargo being transported in the truck.

It will be obvious to those skilled in the art that other modifications may be made to the invention described herein without departing from the spirit and scope of the present invention.

What is claimed is:

1. A track fitting used in connection with a track extending along an item for securing a covering having a plurality of catches to said item, the track fitting comprising:

a body having a front portion and a rear portion, said rear portion being substantially C-shaped and having a first integral foot and a second integral foot, said first integral foot and said second integral foot defining an opening therebetween, said opening for receiving and securing one of said plurality of catches, and at least one of said first integral foot and said second integral foot for being received in one of a series of openings defined by the track;

a plunger having a lower end and defining a front portion receiving aperture, said plunger cooperating with said front portion between a first position and a second position, said front portion receiving aperture receiving said front portion, said plunger lower end being disengaged from the track when said lower end is pulled upwards to the first position, allowing movement of the track fitting along the track, and said lower end engages the track at one of the openings defined by the track when said lower end is placed in the second position, preventing further movement of the track fitting along the track;

wherein said body further comprises a projection that extends through a projection receiving aperture defined by said plunger, said projection defining a cable receiving aperture therethrough; and a cable receivable in said cable receiving aperture for preventing said plunger from being pulled upward to the first position.

2. A system for securing a pallet of cargo comprising:

a track extending around the perimeter of the pallet;

a covering for enclosing the pallet, said covering having a plurality of catches; and a plurality of fittings for securing one of said plurality of catches to the track, each fitting including a body having a front portion and a rear portion, said rear portion being substantially C-shaped and having a first integral foot and a second integral foot, said first integral foot and said second integral foot defining an opening therebetween, said opening for receiving and securing one of said plurality of catches, at least one of said first integral foot and said second integral foot being received in one of a series of openings defined by the track, and a plunger having a lower end and defining a front portion receiving aperture, said plunger cooperating with said front portion between a first position and a second position, said front portion receiving aperture receiving said front portion, said plunger lower end being disengaged from the track when said lower end is pulled upwards to the first position, allowing movement of the track fitting along the track, and said lower end engages the track at one of the openings defined by the track when said lower end is placed in the second position, preventing further movement of the track fitting along the track, and a cable having a first end and a second end, wherein said body further comprises a projection that extends through a projection receiving aperture defined by said plunger, said projection defining an defining a cable receiving aperture for receiving said cable to disable said plunger from being pulled upward to the first position.

3. The system as recited in claim 2, wherein the ends of said cable are secured to one another to prevent the undesired removal of said cable from said cable receiving aperture of said projection.

4. The system as recited in claim 3, wherein a tracking label is secured to the ends of said cable.

5. In a system for securing cargo that includes a track extending substantially about the periphery of the cargo and a covering having a plurality of catches that is positioned over and substantially encloses said cargo, the improvement comprising:

a track fitting having a body having a front portion and a rear portion, said rear portion being substantially C-shaped and having a first integral foot and a second integral foot, said first integral foot and said second integral foot defining an opening therebetween, said opening for receiving and securing one of said plurality of catches, at least one of said first integral foot and said second integral foot being received in one of a series of openings defined by the track, and a plunger having a lower end and defining a front portion receiving aperture, said plunger cooperating with said front portion between a first position and a second position, said front portion receiving aperture receiving said front portion, said plunger lower end being disengaged from the track when said lower end is pulled upwards to the first position, allowing movement of the track fitting along the track, and said lower end engaging the track at one of the openings defined by the track when said lower end is placed in the second position, preventing further movement of the track fitting along the track, and a cable, said cable having a first end and a second end, wherein said body further comprises a projection that extends through a projection receiving aperture defined by said plunger, said projection defining a cable receiving aperture for receiving said cable to prevent said plunger from being pulled upward to the first position.

6. The system for securing cargo as recited in claim 5, wherein the ends of said cable are secured to one another to prevent the undesired removal of said cable from said cable receiving aperture of said projection.

7. The system for securing cargo as recited in claim 6, wherein a tracking label is secured to the ends of said cable.

* * * * *

UNITED STATES PATENT AND TRADEMARK OFFICE

CERTIFICATE OF CORRECTION

PATENT NO. : 7,517,181 B2
APPLICATION NO. : 11/856952
DATED : April 14, 2009
INVENTOR(S) : Dunaway et al.

It is certified that error appears in the above-identified patent and that said Letters Patent is hereby corrected as shown below:

IN THE CLAIMS:

Claim 2, col. 7, line 2: After the word "projection" delete "defining an"

Signed and Sealed this

Nineteenth Day of May, 2009

John Doll

JOHN DOLL
*Acting Director of the United States Patent and Trademark Office*